US008025003B1

(12) United States Patent
Saur

(10) Patent No.: US 8,025,003 B1
(45) Date of Patent: Sep. 27, 2011

(54) FLUTED FIREARM BARREL

(75) Inventor: Thomas W. Saur, Dearborn, MI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 105 days.

(21) Appl. No.: 12/578,898

(22) Filed: Oct. 14, 2009

(51) Int. Cl.
*F41A 21/00* (2006.01)

(52) U.S. Cl. ..... 89/14.05; 89/14.1; 89/14.7; 42/76.01; 42/76.1; 42/76.02

(58) Field of Classification Search ..... 89/14.05, 89/14.1, 15–14.8; 42/76.01, 76.02, 77, 78, 42/76.1
See application file for complete search history.

(56) References Cited

U.S. PATENT DOCUMENTS

| | | | | | |
|---|---|---|---|---|---|
| 1,789,835 | A | * | 1/1931 | Pedersen | 89/14.1 |
| 2,609,631 | A | * | 9/1952 | Garand | 42/76.02 |
| 2,663,961 | A | * | 12/1953 | White et al. | 42/79 |
| 2,687,591 | A | * | 8/1954 | Lamb et al. | 42/76.02 |
| 2,699,094 | A | * | 1/1955 | Musser | 89/1.1 |
| 2,852,835 | A | * | 9/1958 | Harvey et al. | 42/78 |
| 2,975,677 | A | * | 3/1961 | Kelly, Jr. | 89/16 |
| 2,981,154 | A | * | 4/1961 | Sweeney | 89/14.5 |
| 3,118,243 | A | * | 1/1964 | Manshel | 42/76.02 |
| 3,179,011 | A | * | 4/1965 | Rahm | 89/14.3 |
| 3,187,633 | A | * | 6/1965 | Tanabe | 89/14.3 |
| 3,228,298 | A | * | 1/1966 | Grandy et al. | 89/16 |
| 3,571,962 | A | * | 3/1971 | Eig | 42/76.02 |
| 3,724,114 | A | * | 4/1973 | Jones et al. | 42/84 |
| 3,769,731 | A | * | 11/1973 | Pachmayr et al. | 42/79 |
| 3,780,465 | A | * | 12/1973 | Polcha | 148/565 |
| 4,546,564 | A | * | 10/1985 | A'Costa | 42/76.01 |
| 4,574,682 | A | * | 3/1986 | Hillman | 89/12 |
| 4,638,713 | A | * | 1/1987 | Milne et al. | 89/14.1 |
| 4,641,567 | A | * | 2/1987 | Creedon | 89/8 |
| 4,945,812 | A | * | 8/1990 | Mazzanti | 89/14.3 |
| 5,119,716 | A | * | 6/1992 | Bartolles | 89/14.3 |
| 5,509,345 | A | * | 4/1996 | Cyktich | 89/14.05 |
| 5,577,555 | A | * | 11/1996 | Hisajima et al. | 165/133 |
| 5,837,921 | A | * | 11/1998 | Rinaldi et al. | 89/14.1 |
| 5,992,512 | A | * | 11/1999 | Tsuri et al. | 165/133 |
| D426,611 | S | * | 6/2000 | Behling | D22/108 |
| 6,324,780 | B1 | * | 12/2001 | Behling | 42/78 |
| 6,508,159 | B1 | * | 1/2003 | Muirhead | 89/14.1 |
| 6,679,156 | B1 | * | 1/2004 | Danou | 89/14.1 |
| 6,722,254 | B1 | * | 4/2004 | Davies | 89/14.3 |
| 7,013,592 | B2 | * | 3/2006 | Olson et al. | 42/76.02 |
| 7,143,680 | B2 | * | 12/2006 | Bender | 89/14.3 |
| 7,594,464 | B2 | * | 9/2009 | Dueck | 89/14.4 |
| 7,861,636 | B1 | * | 1/2011 | Hoffman | 89/14.2 |
| D632,751 | S | * | 2/2011 | Bowers et al. | D22/108 |
| 2002/0112602 | A1 | * | 8/2002 | Champion | 89/14.3 |
| 2007/0193102 | A1 | * | 8/2007 | Briggs | 42/76.02 |
| 2007/0261286 | A1 | * | 11/2007 | Briggs | 42/76.02 |
| 2008/0276795 | A1 | * | 11/2008 | Trigo | 89/14.1 |
| 2010/0229713 | A1 | * | 9/2010 | Heath | 89/14.2 |
| 2010/0307045 | A1 | * | 12/2010 | Taylor | 42/76.1 |

* cited by examiner

*Primary Examiner* — Michelle Clement
(74) *Attorney, Agent, or Firm* — Michael C. Sachs

(57) ABSTRACT

A firearm barrel having barrel flutes on the outer surface of the barrel where the barrel flutes are undercut relative to an outward radial vector from the center of the barrel at an arcuate radial distance that exceeds the arcuate radial distance of an undercut produced by a straight walled flute cutter such that the barrel flutes are hyper-undercut.

2 Claims, 7 Drawing Sheets

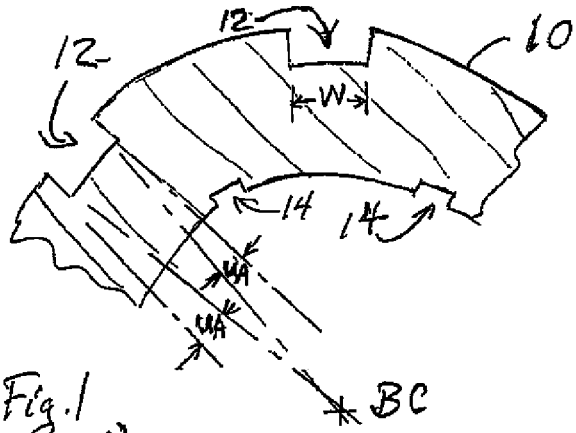
Fig. 1
(conventional)
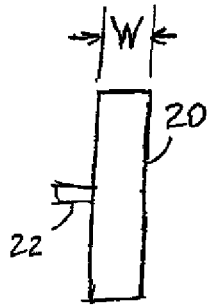
Fig. 2
(conventional)
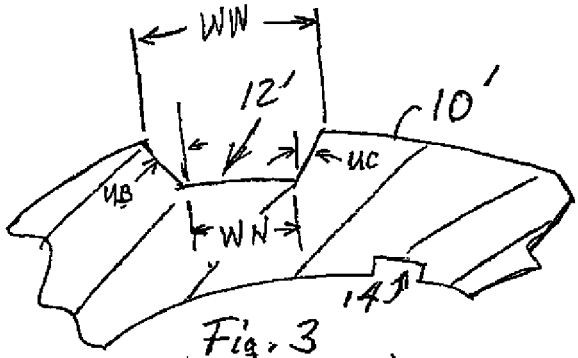
Fig. 3
(conventional)
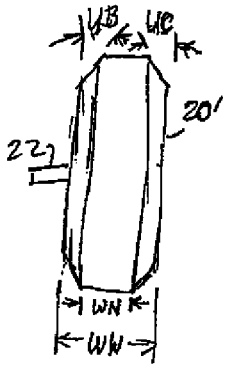
Fig. 4
(conventional)
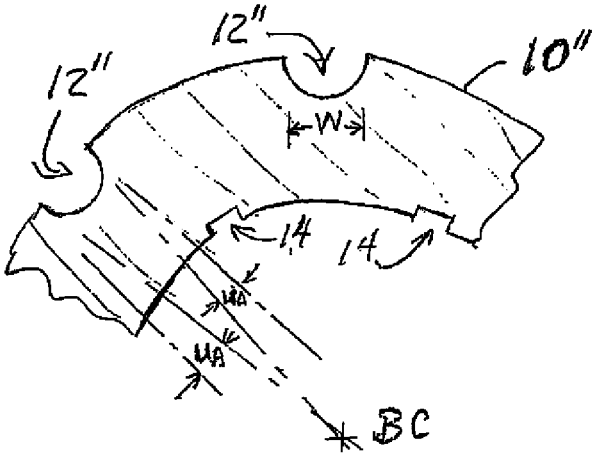
Fig. 5
(conventional)
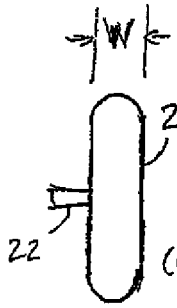
Fig. 6
(conventional)

FLUTED FIREARM BARREL

GOVERNMENT INTEREST

The inventions described herein may be made, used and licensed by and for the U.S. Government for U.S. Government purposes.

BACKGROUND OF THE INVENTION

1. Field of the Invention

The present invention generally relates to a fluted firearm barrel.

2. Background Art

Typical conventional firearm barrel technology includes U.S. Pat. Nos. 3,738,044; 3,483,794; 4,982,648; 5,054,224; 5,448,848; 5,794,374; 6,314,857; 6,324,780; 6,381,895; 6,508,159; and 6,574,898.

Referring to FIG. 1 a diagram illustrating a fragmented sectional view of a portion of a conventional firearm barrel 10 having conventional straight cut flutes (i.e., flutes with undercut, UA) 12 is shown. The barrel 10 is substantially cylindrical with a center of the radial section, BC. When a straight walled cutter (see, for example, FIG. 2) is used to produce the fluting 12, the undercut, UA, is the additional material removed at an arcuate radial distance beyond (outside of) radial vectors from the barrel center, BC, to the outer surface of the barrel 10. The flutes 12 have a width, W, that is the width of the cutting tool (as illustrated in FIG. 2). The barrel 10 may have rifling 14.

Referring to FIG. 2 a diagram illustrating an edge view of an example of a tool 20 for producing the conventional straight cut flutes 12 of FIG. 1 is shown. The tool 20 can be a conventional rotating cutting tool having a shaft 22 and the width, W. The angle of the cut 12 is equal to or less than UA as the tool 20 can not undercut an angle greater than UA.

Referring to FIG. 3 a diagram illustrating a fragmented sectional view of a portion of a conventional firearm barrel 10' having conventional angle cut flutes (i.e., angle cuts UB and UC) 12' is shown. The angle cut flutes 12' typically have a wide width, WW, at the outer surface of the barrel 10' and a narrow width, WN, at the inner surface of the flute 12'.

Referring to FIG. 4 a diagram illustrating an edge view of an example of a tool 20' for producing the conventional angle cut flutes 12' of FIG. 3 is shown. The angle cuts UB and UC may be same or different, but are equal to or less than UA as the tool 20' cannot cut an angle greater than UA.

Referring to FIG. 5 a diagram illustrating a fragmented sectional view of a portion of a conventional firearm barrel 10" having conventional semi-circular cut flutes 12" is shown. The angle cut flutes 12' typically have a diameter equal to the width, W.

Referring to FIG. 6 a diagram illustrating an edge view of an example of a tool 20" for producing the conventional angle cut flutes 12" of FIG. 5 is shown. The angle of the cut 12" is equal to or less than UA as the tool 20" can not undercut an angle greater than UA.

A conventional firearm barrel having conventional spiral flutes is shown, for example, in U.S. Pat. No. 6,324,780, on FIGS. 1 and 2 as gun barrel 10. U.S. Pat. No. 6,324,780 is incorporated herein by reference in its entirety.

However, conventional flutes may fail to provide a sufficient increase in surface area over that of an unfluted barrel to provide a desired amount of heat dissipation while maintaining barrel stiffness close to that of an unfluted barrel. Conventional flutes may fail to provide the desired amount of weight reduction. Conventional add-on (i.e., accessory) cooling devices such as bolt-on heat sinks may fail to provide a sufficient combination of heat dissipation and barrel stiffness as such devices are not integral to the barrel. Such add-on devices increase the weight of the weapon.

Thus, there exists a need and an opportunity for an improved fluted firearm barrel. Such an improved fluted firearm barrel may overcome one or more of the deficiencies of the conventional approaches.

SUMMARY OF THE INVENTION

The present invention may be directed to a firearm barrel having barrel flutes on the outer surface of the barrel where (i) the barrel flutes are undercut relative to an outward radial vector from the center of the barrel at an arcuate radial distance that exceeds the arcuate radial distance of an undercut produced by a straight walled flute cutter (i.e., the barrel flutes are hyper-undercut), and (ii) at least one of (a) the barrel flutes are at a spiral longitudinally along the barrel and have a spiral that is tighter (closer) at the muzzle end of the barrel than at the chamber end, (b) the barrel flutes are wider at the muzzle end of the barrel than at the chamber end, and (c) there are more flutes formed at the muzzle end of the barrel than at the chamber end. The present invention may further provide a firearm barrel having primary and secondary barrel flutes on the outer surface of the barrel. The present invention may also be directed to a method of producing such a firearm barrel. The present invention may provide enhanced barrel cooling while maintaining barrel stiffness.

Accordingly, a firearm barrel having an outer surface, a bore, a muzzle end, and a chamber end is provided. The firearm barrel comprises barrel flutes having respective ribs on the outer surface of the barrel. The barrel flutes are undercut relative to an outward radial vector from the center of the barrel at an arcuate radial distance that exceeds the arcuate radial distance of an undercut produced by a straight walled flute cutter such that the barrel flutes are hyper-undercut.

The barrel flutes may be at a spiral longitudinally along the barrel and the spiral is generally tighter at the muzzle end of the barrel than at the chamber end.

The barrel flutes may be wider at the muzzle end of the barrel than at the chamber end.

The firearm barrel may have more flutes formed at the muzzle end of the barrel than at the chamber end.

The barrel flutes may be hyper-undercut formed using a two-pass process.

The bore may have rifling and the barrel flutes may be spiraled to oppose the rifling, thus opposing the torque applied to the barrel when a bullet proceeds through the barrel.

The barrel flutes may be straight or spiraled.

The barrel flute ribs may be substantially T-shaped with a vertical bar with substantially straight walls and a rounded top cross-bar.

The barrel flute ribs may be substantially T-shaped with a vertical bar and a rounded top cross-bar where the vertical bar is formed by a substantially semi-circular undercut.

The barrel flute ribs may be substantially inverted V-shaped with a vertical bar with substantially straight walls and a rounded top.

The barrel flute ribs may be substantially inverted V-shaped with the V intersecting the bottom of the respective flutes and having a rounded top.

The barrel flute undercuts may be rough cut or abraded to increase radiation efficiency.

The barrel flutes may be finished in flat black to increase radiation efficiency.

The firearm barrel may further comprise secondary flutes. The secondary flutes may be formed on the ribs on the outer surface of the barrel.

Also according to the present invention, method of reducing the weight of a firearm barrel having an outer surface, a bore, a muzzle end, and a chamber end is provided. The method comprises forming barrel flutes having respective ribs on the outer surface of the barrel, and undercutting the flutes relative to an outward radial vector from the center of the barrel at an arcuate radial distance that exceeds the arcuate radial distance of an undercut produced by a straight walled flute cutter such that the barrel flutes are hyper-undercut.

The barrel flutes of the method may be at a spiral longitudinally along the barrel and the spiral is generally tighter at the muzzle end of the barrel than at the chamber end.

The barrel flutes of the method may be wider at the muzzle end of the barrel than at the chamber end.

There may be more flutes formed by the method at the muzzle end of the barrel than at the chamber end.

The barrel flute ribs of the method may be either of substantially T-shaped or substantially inverted V-shaped with a vertical bar, and with substantially straight walls and a rounded top cross-bar.

The barrel flute ribs of the method may be substantially inverted V-shaped with the V intersecting the bottom of the respective flutes and having a rounded top.

The method may further comprise forming secondary flutes, wherein the secondary flutes are formed on the ribs on the outer surface of the barrel.

The above features, and other features and advantages of the present invention are readily apparent from the following detailed descriptions thereof when taken in connection with the accompanying drawings.

BRIEF DESCRIPTION OF THE DRAWINGS

FIG. 1 is a diagram illustrating a fragmented sectional view of a portion of a conventional firearm barrel having conventional straight cut flutes;

FIG. 2 is a diagram illustrating an edge view of an example of a tool for producing the conventional straight cut flutes of FIG. 1;

FIG. 3 is a diagram illustrating a fragmented sectional view of a portion of a conventional firearm barrel having conventional angle cut flutes;

FIG. 4 is a diagram illustrating an edge view of an example of a tool for producing the conventional angle cut flutes of FIG. 3;

FIG. 5 is a diagram illustrating a fragmented sectional view of a portion of a conventional firearm barrel having conventional semi-circular cut flutes;

FIG. 6 is a diagram illustrating an edge view of an example of a tool for producing the conventional semi-circular cut flutes of FIG. 5;

DETAILED DESCRIPTION OF THE PREFERRED EMBODIMENT(S)

With reference to the Figures, the preferred embodiments of the present invention will now be described in detail. Generally, the present invention provides an improved fluted firearm barrel, and a method for making the improved fluted firearm barrel.

The present invention is generally directed to a firearm barrel having barrel flutes on the outer surface of the barrel where the barrel flutes are undercut relative to an outward radial vector from the center of the barrel at an arcuate radial distance that exceeds the arcuate radial distance of an undercut produced by a straight walled flute cutter (i.e., the barrel flutes are hyper-undercut). In various example implementations, (i) the barrel flutes are at a spiral longitudinally along the barrel the spiral is tighter (closer) at the muzzle end of the barrel than at the chamber end, (ii) the barrel flutes are wider at the muzzle end of the barrel than at the chamber end, and (iii) there are more flutes formed at the muzzle end of the barrel than at the chamber end. The present invention may further provide a firearm barrel having primary and secondary barrel flutes on the outer surface of the barrel.

When spiraling is implemented, the spiral cut flutes may be counter-directional to (i.e., opposing) the rifling in the barrel at a depth and shape selected to counteract torque and barrel twisting generated during cartridge firing (i.e., the torque generated as a bullet proceeds through the barrel).

At least one of the number, shape and resulting degree of undercut of the flutes, whether secondary as well as primary flutes are implemented, the degree/amount (tightness) of spiraling, the width of the flutes, and the width of channel are generally determined (e.g., selected, calculated, chosen, etc.) based on (in response to) at least one of such parameters (i.e., characteristics, design criteria, etc.) as the desired level of stiffness, the desired weight reduction, pressure characteristics of the respective cartridge and discharge thereof, tuning of barrel and firearm assembly for optimization of accuracy, and the desired amount of thermal radiation.

Adequate barrel thickness is generally maintained between the rifling and the spiraling to ensure safe firearm operation. The flutes may be rough-cut or abraded to increase effective surface area, and increase and improve thermal radiation. The flutes may have a flat black surface finish applied to further enhance thermal radiation.

The flutes of the invention may be formed (produced) by machining via an appropriately shaped cutter, milling, scraping, electronic discharge machining (EDM), button forming, and the like. Hyper-undercut flutes may be formed using a two-pass process comprising first cutting a conventional flute and then undercutting the flute. EDM forming may produce hyper-undercut flutes in a single pass.

Figure 7:
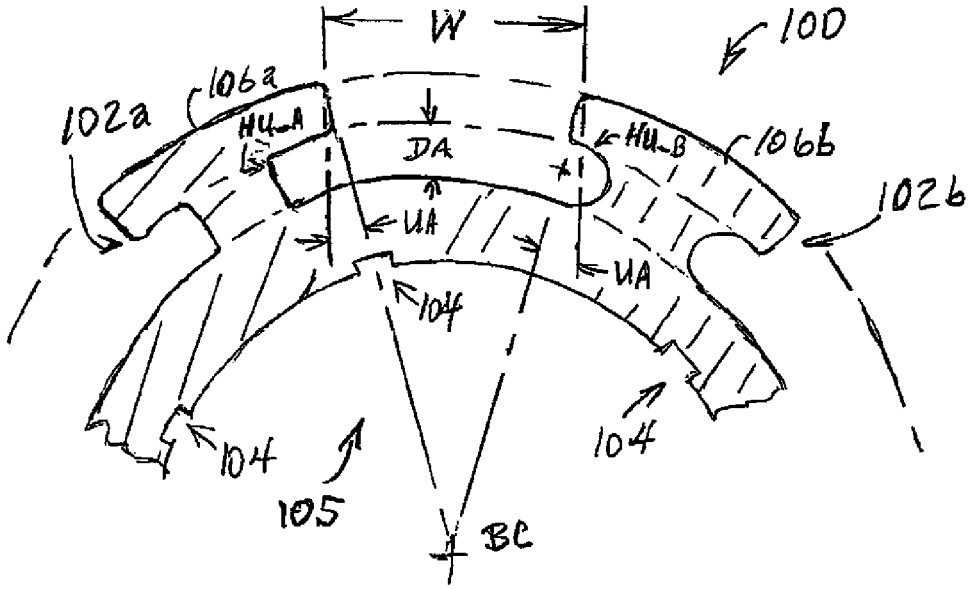
FIG. 7 is a fragmented sectional view of a firearm barrel having two example hyper-undercut flutes of the present invention.

Referring to FIG. 7, a diagram illustrating a fragmented sectional view of a firearm barrel 100 having two example hyper-undercut flutes 102 (e.g., flutes 102*a* and 102*b*) of the present invention is shown. The firearm barrel 100 is generally a cylinder with flutes formed into the outer surface thereof. Hyper-undercuts HU_A and HU_B as shown exceed conventional undercut UA of FIG. 1. As described below in connection with FIGS. 10(A-D), the flutes 102 may be implemented as primary flutes, and secondary flutes may further be implemented.

In one example, the barrel 100 may have rifling 104 formed in a bore 105. In another example (not shown), the barrel 100 may be a smooth bore barrel (i.e., a barrel with no rifling). The rifling 104 may be formed by any process (e.g., cutting, button forming, forging, and the like) and may be of any shape (e.g., channel, polygon, etc.) to meet the design criteria of a particular application.

Respective ribs 106 (e.g., barrel flute ribs 106*a* and 106*b*) are generally formed on the outer surface of the barrel 100 when the fluting 102 is implemented. In one example (i.e., the fluting 102*a* and the respective rib 106*a*), the ribs 106 may be substantially T-shaped with a vertical bar with substantially straight walls and having a length, DA, and a rounded top cross-bar. In another example (i.e., the fluting 102*b* and the respective rib 106*b*), the ribs 106 may be substantially T-shaped with a vertical bar having the length, DA, and a rounded top cross-bar, however, the vertical bar may be formed by a substantially semi-circular undercut having a diameter that is the height, DA.

Figure 8:
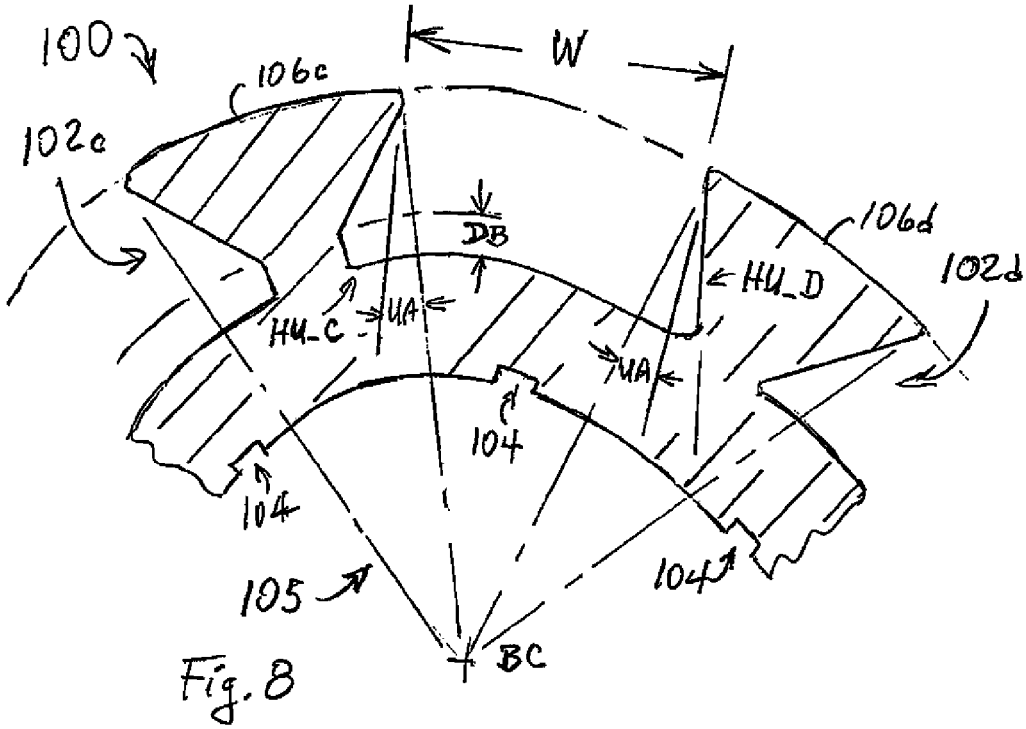
FIG. 8 is a fragmented sectional view of a firearm barrel having two further example hyper-undercut flutes of the present invention.
Figure 9A:
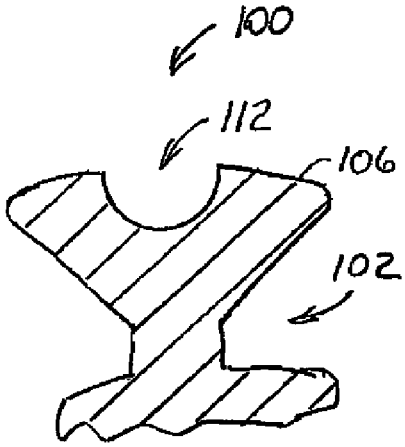
FIGS. 9 (A-D) are sectional views of firearm barrels having examples of secondary flutes of the present invention.
Figure 9B:
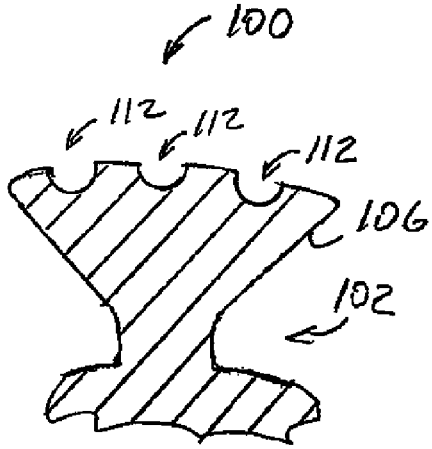
Figure 9C:
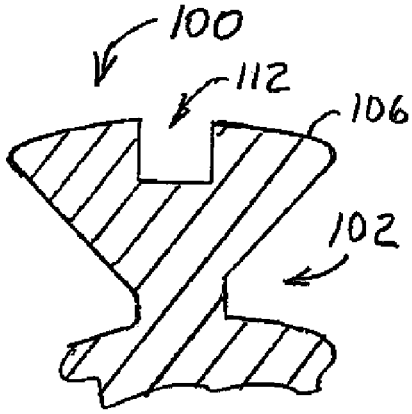
Figure 9D:
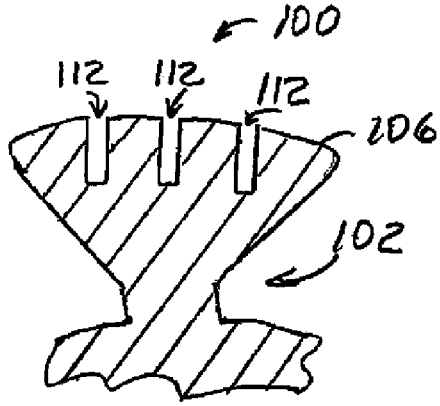

Referring to FIG. 8, a diagram illustrating a fragmented sectional view of a firearm barrel 100 having two further example hyper-undercut primary flutes 102 (e.g., flutes 102*c* and 102*d*) of the present invention is shown. Hyper-undercuts HU_C and HU_D as shown exceed conventional undercut UA.

In one example (i.e., the fluting 102*c* and the respective barrel flute rib 106*c*), the ribs 106 may be substantially inverted V-shaped with a vertical bar with substantially straight walls and having a length, DB, and a rounded top. In another example (i.e., the fluting 102*d* and the respective barrel flute rib 106*d*), the ribs 106 may be substantially inverted V-shaped with the V intersecting the bottom of the respective flutes 102, and having a rounded top.

Referring to FIGS. 9(A-D), diagrams illustrating fragmented sectional views of the firearm barrel 100 having secondary flutes (e.g., grooves, recesses, channels, etc.) 112 as well as the primary hyper-undercut flutes 102 are shown. The secondary flutes 112 are generally formed in the cross-bar region on the outer surface of the barrel 100 on top of the rib 106 and between respective primary flutes 102. The secondary flutes 112 may provide additional heat dissipation.

In one example (e.g., as illustrated in FIGS. 9(A-B)), the secondary flutes 112 may be implemented as at least one substantially semi-circular cut firearm barrel flute. In another example (e.g., as illustrated in FIGS. 9(C-D)), the secondary flutes 112 may be implemented as at least one substantially rectangular cur firearm barrel flute. However, any number of the flutes 112 may be implemented having any appropriate shape to meet the design criteria of a particular application. The secondary flutes 112 generally have less surface area individually than do individual primary flutes 102 on a particular application.

Figure 10:
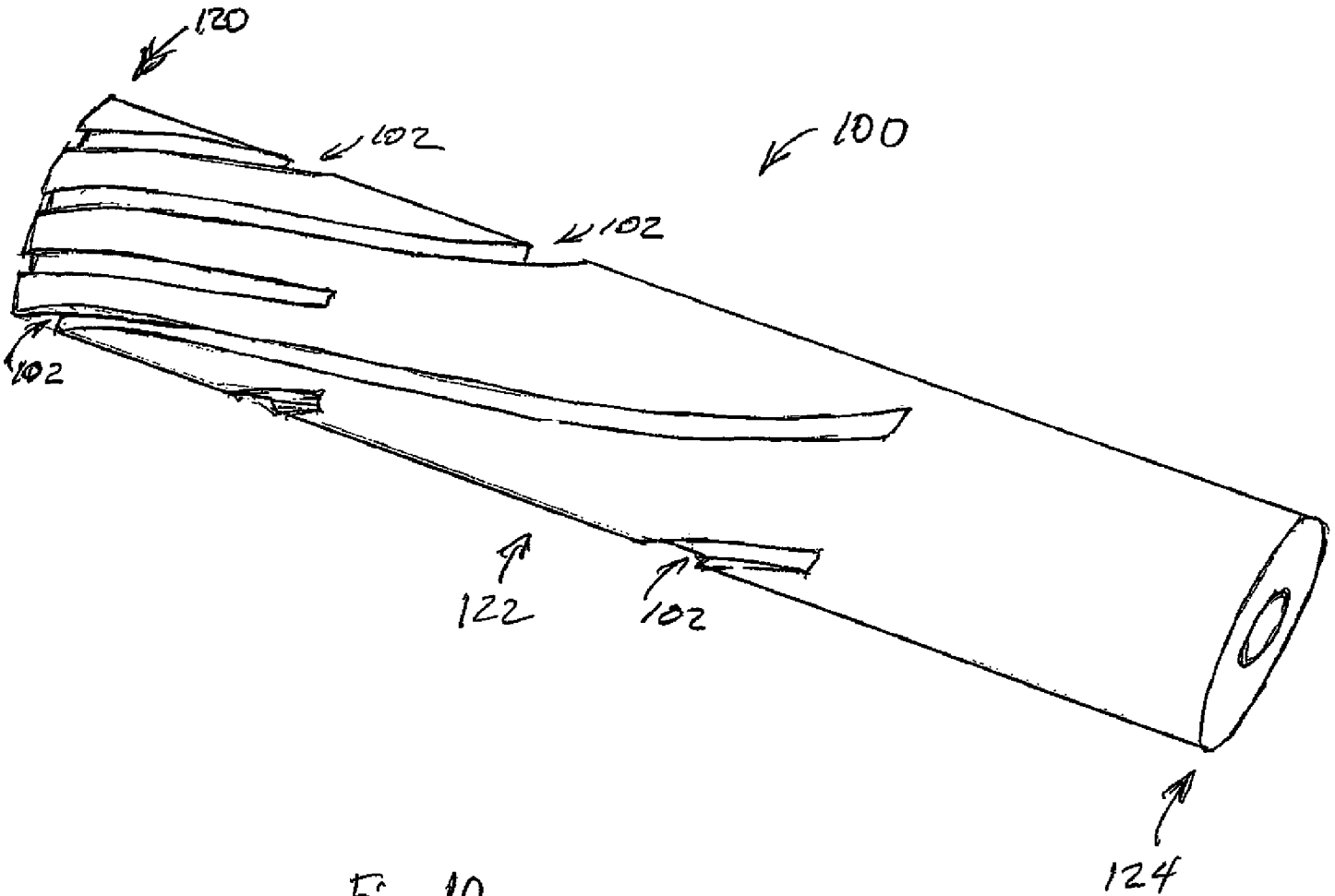
FIG. 10 is an isometric view of one example of a fluted firearm barrel of the present invention.

Referring to FIG. 10, is an isometric view of one example of a fluted firearm barrel 100 of the present invention (twisted flutes 102, greater number of flutes 102 at muzzle end 120 than at center section 122 and at breech/chamber end 124, detail of flutes 102 and respective barrel flute ribs 106 omitted for clarity) is shown.

Figure 11:
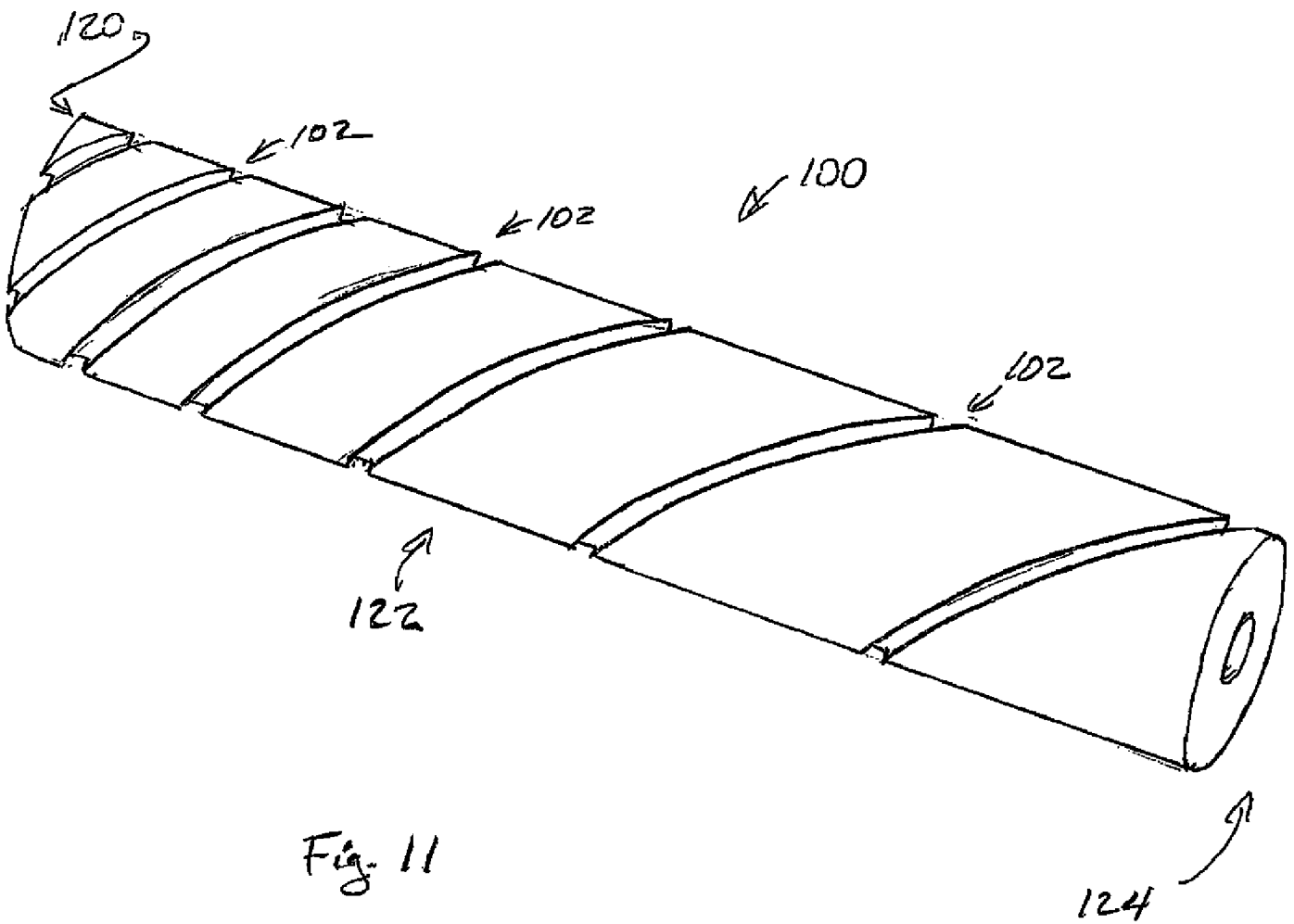
FIG. 11 is an isometric view of another example of a fluted firearm barrel of the present invention.

Referring to FIG. 11, an isometric view of another example of a fluted firearm barrel 100 of the present invention (twisted flutes 102, greater number of twists at muzzle end 120 than at center section 122, detail of flutes 102 and respective barrel flute ribs 106 omitted for clarity) is shown.

Figure 12:
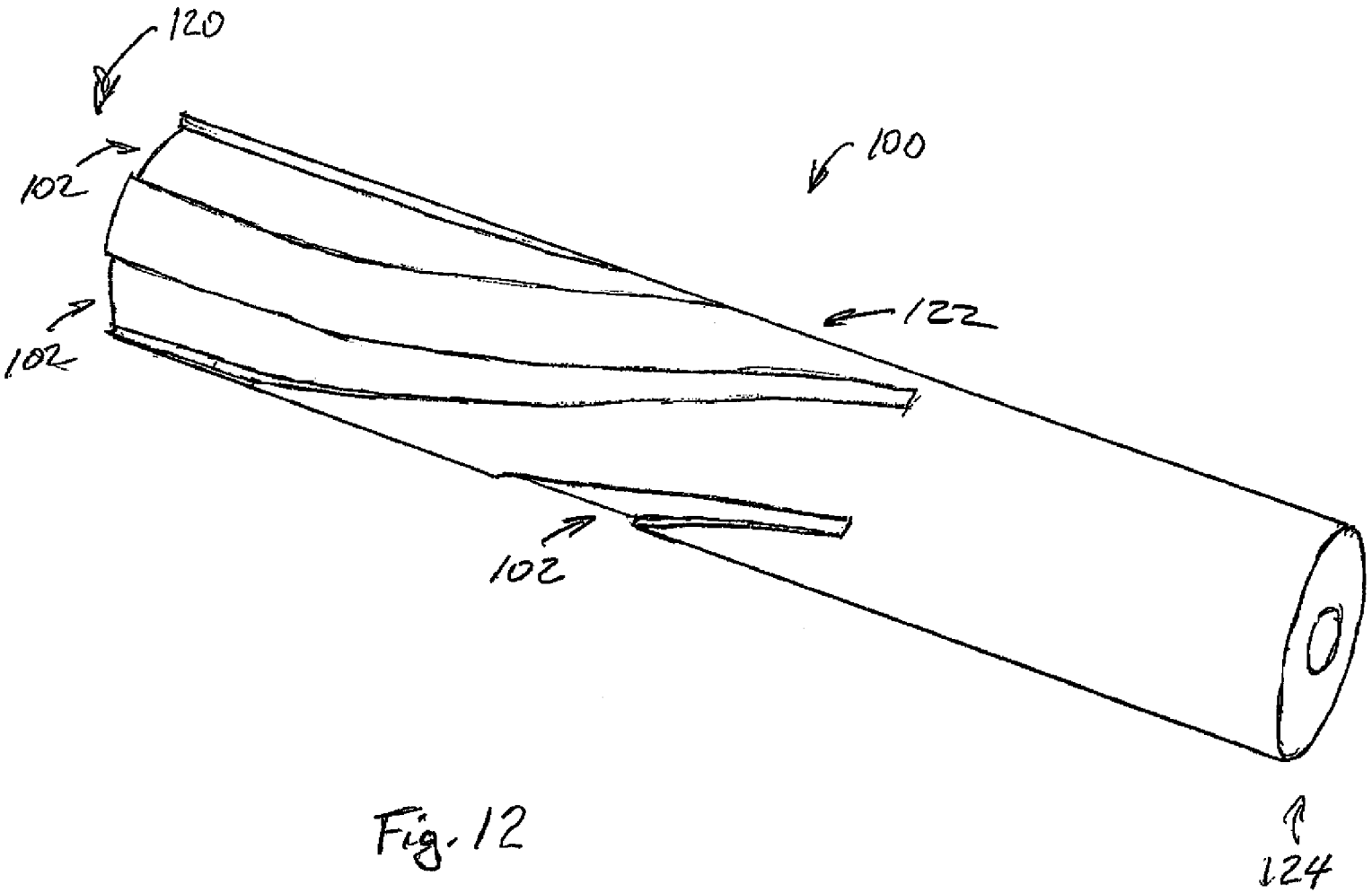
FIG. 12 is an isometric view of yet another example of a fluted firearm barrel of the present invention.

Referring to FIG. 12, is an isometric view of yet another example of a fluted firearm barrel 100 of the present invention (twisted flutes 102, flute channels with greater width at muzzle end than at center section 122, detail of flutes 102 and respective barrel flute ribs 106 omitted for clarity) is shown.

Figure 13:
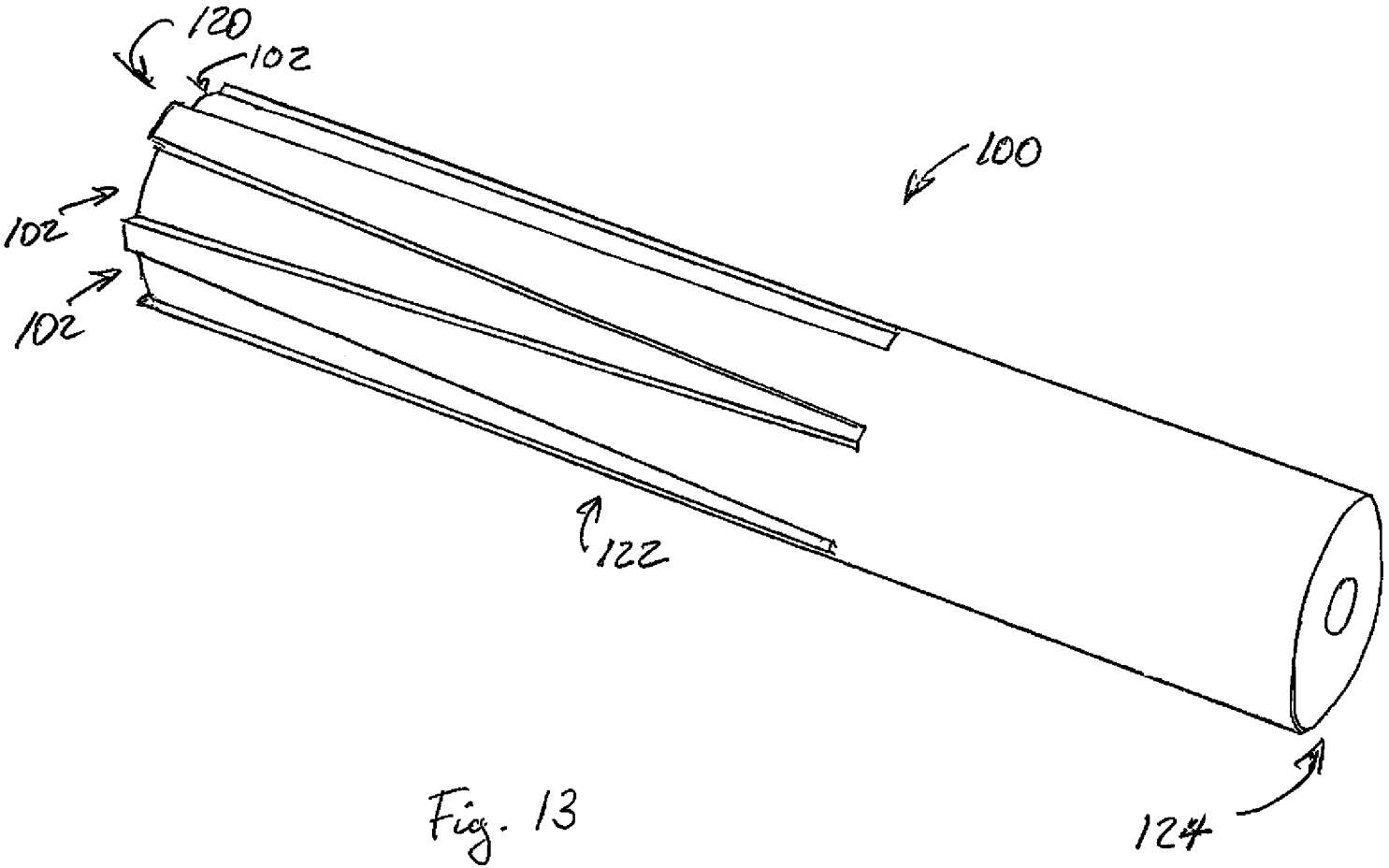
FIG. 13 is an isometric view of a further example of a fluted firearm barrel of the present invention.

Referring to FIG. 13, an isometric view of a further example of a firearm fluted barrel 100 of the present invention (non-twisted flutes 102, flute channels with greater width at muzzle end 120 than at center section 122, detail of flutes 102 and respective barrel flute ribs 106 omitted for clarity) is shown.

As is apparent then from the above detailed description, the present invention may provide an improved apparatus and method for:

Barrel flutes (or fluting) that are hyper-undercut (may be formed using a two-pass process);

Barrel flutes having a spiral that is tighter at the muzzle end of the barrel than at the chamber end. (The flutes are spiraled to oppose the rifling on the bore of the firearm barrel, thus oppose the torque/twisting applied to the barrel when a bullet proceeds through the barrel);

Channels in the outer surface of barrel resulting from the flutes that are wider at the muzzle end of the barrel than at the chamber end. Flutes may be straight or spiraled; and Secondary as well as primary flutes may be implemented.

When compared to conventional fluted firearm barrel flutes, hyper-undercuts of the present invention provide (i) more surface area thus more heat dissipation and (ii) barrel stiffness closer to that of an unfluted barrel. The undercuts may be rough cut or abraded and finished in flat black to increase radiation efficiency. Secondary flutes may also be implemented to increase radiation efficiency. The fluted barrel of the present invention may be implemented in connection with firearms of any size, that is, hand guns, shoulder fired weapons, artillery, cannons, etc.

When compared to conventional fluted barrel and a conventional tapered barrel, a barrel with flutes having a spiral that is tighter (or channels resulting from the flutes that are wider) at the muzzle end of the barrel than at the chamber end provides more strength at the chamber end where pressure is greater and lighter weight at the muzzle end such that a shooter can maneuver the firearm more rapidly than a conventional unfluted barrel while maintaining desired barrel stiffness.

The present invention also provides the generally higher projectile velocities and longer sighting radius of a longer barreled firearm while providing lower mass to reduce transportation effort and high surface area for improved thermal radiation from the barrel outer surface. Less material at the muzzle end of the barrel may make the attachment of accessories such as muzzle brakes, compensators, flash suppressors, muzzle flash and weapon noise signature modifiers, sound suppressors, and the like easier to install, and the formation of barrel porting easier to perform.

Various alterations and modifications will become apparent to those skilled in the art without departing from the scope and spirit of this invention and it is understood this invention is limited only by the following claims.

What is claimed is:

1. A firearm barrel having an outer surface, a bore, a muzzle end, and a chamber end, the firearm barrel comprising:

barrel flutes having respective ribs on the outer surface of the barrel wherein the barrel flutes are undercut relative to an outward radial vector from the center of the barrel at an arcuate radial distance that exceeds the arcuate radial distance of an undercut produced by a straight walled flute cutter such that the barrel flutes are hyper-undercut, the firearm barrel further comprising secondary flutes, wherein the secondary flutes are formed on the ribs on the outer surface of the barrel.

2. A method of reducing the weight of a firearm barrel having an outer surface, a bore, a muzzle end, and a chamber end, the method comprising:

forming barrel flutes having respective ribs on the outer surface of the barrel; and undercutting the flutes relative to an outward radial vector from the center of the barrel at an arcuate radial distance that exceeds the arcuate radial distance of an undercut produced by a straight walled flute cutter such that the barrel flutes are hyper-undercut, the method further comprising forming secondary flutes, wherein the secondary flutes are formed on the ribs on the outer surface of the barrel.

* * * * *

UNITED STATES PATENT AND TRADEMARK OFFICE

CERTIFICATE OF CORRECTION

PATENT NO. : 8,025,003 B1
APPLICATION NO. : 12/578898
DATED : September 27, 2011
INVENTOR(S) : Thomas W. Saur It is certified that error appears in the above-identified patent and that said Letters Patent is hereby corrected as shown below:

Cover Page (73), "Navy" should read --Army--.

Signed and Sealed this
Twenty-ninth Day of January, 2013

David J. Kappos

David J. Kappos
*Director of the United States Patent and Trademark Office*